US011401933B2

(12) United States Patent
Lee et al.

(10) Patent No.: US 11,401,933 B2
(45) Date of Patent: Aug. 2, 2022

(54) SCROLL-TYPE COMPRESSOR

(71) Applicant: LG Electronics Inc., Seoul (KR)

(72) Inventors: Kyungho Lee, Seoul (KR); Cheolhwan Kim, Seoul (KR); Howon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 139 days.

(21) Appl. No.: 16/837,658

(22) Filed: Apr. 1, 2020

(65) Prior Publication Data

US 2020/0318637 A1 Oct. 8, 2020

(30) Foreign Application Priority Data

Apr. 2, 2019 (KR) ..... 10-2019-0038362

(51) Int. Cl.

| | |
|---|---|
| ***F01C 1/02*** | (2006.01) |
| ***F04C 18/02*** | (2006.01) |
| ***F04C 29/02*** | (2006.01) |
| ***F04C 2/02*** | (2006.01) |
| ***F04C 23/00*** | (2006.01) |
| ***F04C 15/00*** | (2006.01) |

(52) U.S. Cl.

CPC ..... *F04C 15/0092* (2013.01); *F04C 2/025* (2013.01); *F04C 2210/206* (2013.01); *F04C 2240/603* (2013.01)

(58) Field of Classification Search

CPC .... F04C 15/0092; F04C 2/025; F04C 29/023; F04C 29/028; F04C 18/02; F04C 29/02; F04C 2/02; F04C 23/00; F01C 1/02

See application file for complete search history.

(56) References Cited

U.S. PATENT DOCUMENTS

2018/0051697 A1* 2/2018 Murakami ..... F04C 15/0088
2020/0318636 A1* 10/2020 Lee ..... F04C 23/008

FOREIGN PATENT DOCUMENTS

| | | |
|---|---|---|
| EP | 3418575 | 12/2018 |
| JP | 2001020888 | 1/2001 |
| JP | 2007285304 | 11/2007 |
| JP | 5433865 | 3/2014 |
| KR | 1020110006181 | 1/2011 |
| KR | 101099117 | 12/2011 |
| KR | 1020110131751 | 12/2011 |
| KR | 1020180136282 | 12/2018 |
| KR | 1020180138479 | 12/2018 |

OTHER PUBLICATIONS

Korean Office Action in Korean Application No. 10-2019-0038362, dated Apr. 20, 2020, 10 pages (with English translation).
Extended European Search Report in European Application No. 20167641.8, dated Jul. 10, 2020, 8 pages.
Korean Office Action in Korean Application No. 10-2019-0038362, dated Oct. 16, 2020, 7 pages (with English translation).

* cited by examiner

*Primary Examiner* — Deming Wan
(74) *Attorney, Agent, or Firm* — Fish & Richardson P.C.

(57) ABSTRACT

A compressor is disclosed, which comprises a regulate portion provided in at least one of a main frame and a fixed scroll to control or selectively shield an opening of a delivery path or a fixed path.

19 Claims, 7 Drawing Sheets

SCROLL-TYPE COMPRESSOR

CROSS-REFERENCE TO RELATED APPLICATION

This application claims the benefit of Korean Patent Application No. 10-2019-0038362, filed on Apr. 2, 2019, which is hereby incorporated by reference as if fully set forth herein.

BACKGROUND

Field

The present disclosure relates to a compressor, and more particularly, to a shaft pass-through scroll compressor that may prevent supplied oil from backward flowing.

Discussion of the Related Art

Generally, a compressor is an apparatus applied to a refrigerant compression type cooling cycle (hereinafter, referred to as a cooling cycle) such as a refrigerator or an air conditioner, and provides a work required for heat exchange in a cooling cycle by compressing a refrigerant.

The compressor may be categorized into a reciprocating compressor, a rotary compressor, and a scroll compressor in accordance with a method of compressing a refrigerant. The scroll compressor performs an orbiting movement by engaging an orbiting scroll with a fixed scroll fixed to an inner space of an airtight container to form a compression chamber between a fixed wrap of the fixed scroll and an orbiting wrap of the orbiting scroll.

Since the scroll compressor is continuously compressed through scroll shapes engaged with each other, the scroll compressor may obtain a relatively high compression ratio as compared with the other types of compressors, and may obtain a stable torque in accordance with a smooth flow of suction, compression, and discharge strokes of the refrigerant. For these reasons, the scroll compressor is widely used for refrigerant compression in an air conditioning system, etc.

Referring to Japanese registered patent No. 6344452, a scroll compressor of the related art includes a case forming an external appearance and having a discharge outlet through which a refrigerant is discharged, a compression unit fixed to the case, compressing the refrigerant, and a driving unit fixed to the case, driving the compression unit, wherein the compression unit and the driving unit are connected with each other by a rotary shaft rotated by being coupled to the driving unit.

The compression unit includes a fixed scroll fixed to the case, having a fixed wrap, and an orbiting scroll that includes an orbiting wrap driven by the rotary shaft by being engaged with the fixed wrap. In this scroll compressor of the related art, the rotary shaft is provided to be eccentric, and the orbiting scroll is provided to be rotated by being fixed to the eccentric rotary shaft. As a result, the orbiting scroll compresses the refrigerant while orbiting along the fixed scroll.

In the scroll compressor of the related art, it is general that the compression is provided below the discharge outlet and the driving unit is provided below the compression unit. The rotary shaft is provided such that its one end is coupled to the compression unit and its other end passes through the driving unit.

In the scroll compressor of the related art, since the compression unit is provided above the driving unit and close to the discharge outlet, problems occur in that it is difficult to supply oil to the compression unit and a lower frame is additionally required to allow a lower portion of the driving unit to separately support the rotary shaft connected to the compression unit. Also, since a gas power for generating the refrigerant in the compressor is not matched with an action point of a repulsive force supporting the gas power, a scroll is tilted, whereby efficiency and reliability are deteriorated.

In order to solve these problems, a scroll compressor (lower scroll compressor) has been recently developed, in which a driving unit exists below a discharge outlet and a compression unit is arranged below the driving unit, as disclosed in the Korean Publication Patent No. 10-2018-0124636.

FIGS. 1A and 1B illustrate a structure of a lower scroll compressor of the related art.

Referring to FIGS. 1A and 1B, it is general that the lower scroll compressor 10 of the related art is provided on a circuit of a refrigerant cycle provided with a condenser 2, an expansion valve 3 and an evaporator 4.

In the lower scroll compressor, a driving unit 200 is provided to be more adjacent to a discharge outlet 121 than a compression unit 300, and the compression unit 300 is provided to be most spaced apart from the discharge outlet 121. In this lower scroll compressor, a rotary shaft 230 has one end connected with the driving unit 200 and the other end supported in the compression unit 300, whereby a separate lower frame for supporting the rotary shaft may be omitted, and oil P stored in one side of a case may directly be supplied to the compression unit 300 without through the driving unit 200. Also, in the lower scroll compressor, since the rotary shaft 230 is connected with the compression unit 300 to pass through the compression unit 300, a gas power is matched with an action point of a repulsive force on the rotary shaft 230, whereby tilting of a scroll in the compression unit 300 may be avoided and tilting moment may be counterbalanced to make sure of efficiency and reliability.

Referring to FIG. 1B, the compression unit 300 includes a main frame 310 supporting the rotary shaft 230 to pass through the rotary shaft 230, a fixed scroll 320 mounted on the main frame 310, forming a compression chamber, and an orbiting scroll 330 provided in the compression chamber to compress the refrigerant.

If a refrigerant enters a fixed wrap 323 provided in the fixed scroll from an inlet hole 325 provided at a side of the fixed scroll 320, the orbiting wrap 333 provided in the orbiting scroll compresses the refrigerant through orbiting movement, and the compressed refrigerant is discharged to a discharge hole 326 provided near the rotary shaft 230.

At this time, a high pressure area S1 is formed near the rotary shaft 230 due to the compressed refrigerant, and the refrigerant generates a force pushing the orbiting scroll 330 toward the driving unit 200, in the high pressure area S1. Therefore, in the scroll compressor, a back pressure seal 350 may be provided above the orbiting scroll 330 to generate a back pressure that counterbalances the above force through the oil supplied through the rotary shaft 230 and the refrigerant which is in contact with the main frame.

The rotary shaft 230 ascends the stored oil P through a plurality of oil supply holes 234*a*, 234*b* and 234*c* and a plurality of oil supply grooves 2341*a*, 2341*b* and 2341*c* and supplies the oil P to a main bearing 232*a*, an eccentric portion 232*b* and a fixed bearing 232*c*.

Meanwhile, an intermediate pressure area V1 having a pressure smaller than that of the high pressure area is formed on an outer circumferential surface of the back pressure seal 350, and a low pressure area S2 may be formed in a portion of Oldham's ring 340 provided for orbiting movement of the orbiting scroll. The oil supplied from the supplied rotary shaft 230 may be supplied to the fixed wrap and the orbiting wrap or the Oldham's ring 340 through a delivery path 339 and a fixed path 329 by a pressure difference of the high pressure area S1 and the intermediate pressure area V1 or the low pressure area S2. (That is, a differential pressure oil supply method may be applied.)

For example, the delivery path 339 may further include an orbiting inlet path 3391 through which the oil delivered from the first oil supply hole 234*a* or the first oil supply groove 2341*a* enters the orbiting scroll, a connecting path 3392 extended from the orbiting inlet path to an outer circumferential surface of the orbiting scroll, and an opening path 3393 diverged from the connecting path 3392 toward the Oldham's ring and extended to one surface of the orbiting scroll. Also, the fixed path 329 may include an inflow path 3291 provided in a fixed side plate to be communicated with the connecting path 3392, allowing the oil supplied to the delivery path to enter there, and a supply path 3292 and a lubricating path 3293 provided in a fixed end plate to be communicated with the inflow path 3291, moving the oil supplied to the inflow path to the fixed wrap 323.

The delivery path 339 may be provided to be extended to a diameter direction of the orbiting scroll 330 and deliver the oil supplied through the rotary shaft 230 to an outer circumferential surface of the fixed wrap 323 of the fixed scroll. The fixed path 329 may be provided in the fixed scroll to be communicated with the delivery path 339 and supply the oil supplied to the delivery path 339 to the intermediate pressure area V1.

However, the oil may excessively be supplied from the rotary shaft 230 due to a great pressure difference between the intermediate pressure area V1 and the high pressure area S1. Therefore, a problem may occur in that a sufficient amount of the refrigerant is not compressed or the compression unit 300 is excessively cooled. To solve the problem, the scroll compressor 300 may include a decompression unit 360 inserted into the delivery path 339 to control the supply amount of the oil. The decompression unit 360 may generate path resistance by reducing a sectional area of the delivery path 339, thereby preventing the oil from being excessively supplied.

Meanwhile, the scroll compressor is required to be driven by a low pressure ratio to improve performance of a cooling cycle. That is, the scroll compressor may be driven so as not to generate a great pressure difference between the high pressure area S1 and the intermediate pressure area V1. For example, if a pressure ratio of the high pressure area S1 and the intermediate pressure area V1 is 1.3, the compression unit 300 may be driven to set the pressure ratio to 1.1 or less.

Therefore, even though there is no great temperature difference between an evaporator and a condenser, a refrigerant cycle may be driven normally even by the existing compressor. For example, even though there is no great difference between an inner temperature and an outer temperature, it is not required to greatly increase an electric energy applied to the compressor, whereby a performance coefficient may be maintained or enhanced.

However, if driving of a low pressure ratio is performed, the pressure of the intermediate pressure area V1 becomes smaller than the pressure of the high pressure area S1. Also, if a pressure drop occurs in the high pressure area S1 due to a driving friction near the rotary shaft 230, interference between components, the decompression unit 360 that partially shields the delivery path 339, etc., a reversal phenomenon may occur, in which the pressure of the high pressure area S1 becomes lower than that of the intermediate pressure area V1.

As a result, since the pressure difference (differential pressure) that enables supply of the oil from the high pressure area S1 to the intermediate pressure area V1 is not sufficient, a problem occurs in that oil supply is rapidly reduced. Moreover, a problem occurs in that the oil supplied to the intermediate pressure area V1 backward flows to the high pressure area S1. Therefore, although the performance coefficient has been improved due to driving of the low pressure ratio, a problem occurs in that reliability of the compressor cannot be ensured.

Meanwhile, in the scroll compressor of the related art, the fixed path 329 may be arranged to be communicated with a point of the intermediate pressure V1 or less considering a direction where the refrigerant enters and is discharged (near 0° to 180°). In other words, since the outmost portion of the fixed wrap 323 corresponds to the lowest pressure portion, the fixed path 329 may be communicated with the outmost portion of the fixed wrap 323 proximately to make sure of the differential pressure.

However, if the fixed path 329 is communicated with the area of the intermediate pressure or less, a problem occurs in that the oil is excessively supplied when the compressor is driven at high speed. For this reason, problems occur in that a suction volume of the refrigerant is reduced, the compression unit is cooled due to the oil, and the oil is discharged from the compressor 10 to reduce efficiency of the compressor and fail to ensure reliability of the compressor.

Also, the scroll compressor of the related art has a problem in that the delivery path 339 is provided in the orbiting scroll 330, of which position is variable, so as not to control the supply amount of oil.

SUMMARY

Accordingly, the present disclosure is directed to a compressor that substantially obviates one or more problems due to limitations and disadvantages of the related art.

An object of the present disclosure is to provide a scroll compressor that may prevent oil supplied to a compression unit from backward flowing.

Another object of the present disclosure is to provide a scroll compressor additionally provided with a valve or regulate portion that allows oil supplied to a compression unit to pass but shields backward flowing oil.

Still another object of the present disclosure is to provide a scroll compressor that may stably maintain the supply amount of oil even though an orbiting scroll is driven as a path through which oil is supplied is always provided in a fixed component of a case.

Further still another object of the present disclosure is to provide a scroll compressor that may prevent oil from backward flowing even though a pressure difference between a high pressure area and a low pressure area of a compression unit is not great.

Further still another object of the present disclosure is to provide a scroll compressor that may sufficiently supply oil even though a pressure difference between a high pressure area and a low pressure area of a compression unit is not great.

Further still another object of the present disclosure is to provide a scroll compressor that may normally supply oil even though a compression unit is driven at high pressure or low pressure.

Additional advantages, objects, and features of the present disclosure will be set forth in part in the description which follows and in part will become apparent to those having ordinary skill in the art upon examination of the following or may be learned from practice of the present disclosure. The objectives and other advantages of the present disclosure may be realized and attained by the structure particularly pointed out in the written description and claims hereof as well as the appended drawings.

To achieve these objects and other advantages and in accordance with the purpose of the present disclosure, Particular embodiments described herein include a compressor that includes a driving unit, a rotary shaft, and a compression unit. The rotary shaft may be rotatable by the driving unit and configured to supply oil. The compression unit may be coupled to the rotary shaft and configured to compress a refrigerant. The compression unit may be configured to be lubricated by the oil supplied by the rotary shaft. The compression unit may include an orbiting scroll, a fixed scroll, a main frame, a delivery path, a fixed path, and a regulating portion. The orbiting scroll may be rotatably engaged with the rotary shaft and configured to orbit as the rotary shaft is rotated. The fixed scroll may be engaged with the orbiting scroll and configured to compress and discharge the refrigerant in cooperation with the orbiting scroll. The main frame may be connected with the fixed scroll and receive the orbiting scroll. The main frame may receive the rotary shaft therethrough. The delivery path may be defined at at least one of the orbiting scroll or the main frame and configured to allow the oil supplied from the rotary shaft to move therethrough. The fixed path may fluidly communicate with the delivery path and be configured to convey the oil between the orbiting scroll and the fixed scroll. The regulating portion may be disposed in at least one of the main frame or the fixed scroll and configured to control an opening of the delivery path or the fixed path.

In some implementations, the system can optionally include one or more of the following features. The regulating portion may include a check valve disposed in the at least one of the main frame or the fixed scroll. The check valve may be configured to prevent backflow of the oil in the delivery path or the fixed path. The compressor may include a valve disposed in the main frame or the fixed scroll and configured to control opening of the delivery path or the fixed path. The main frame or the fixed scroll may include an arrangement groove disposed in the delivery path or the fixed path. The regulating portion may include (i) a shielding portion configured to reciprocate in the arrangement groove and block the delivery path or the fixed path and (ii) an elastic portion disposed in the arrangement groove and configured to bias the shielding portion toward the delivery path or the fixed path. The arrangement groove may include (i) a moving path in which the shielding portion reciprocates, and (ii) an accommodating path extended from the moving path and receiving the elastic portion. The regulating portion may include an arrangement module inserted into the arrangement groove. The shielding portion and the elastic portion may be disposed in the arrangement module. The arrangement module may include (i) a moving path that fluidly communicates with the delivery path or the fixed path and that is configured to allow the shielding portion to reciprocate therein, and (ii) an accommodating path extended from the moving path and receiving the elastic portion. The accommodating path may have a diameter smaller than a diameter of the moving path. The arrangement module may include (i) an inlet hole located at one end of the moving path and configured to receive the oil from the delivery path or the fixed path, and (ii) a guide hole located at an outer circumferential surface of the moving path or an outer circumferential surface of the accommodating path and configured to discharge the oil to the delivery path or the fixed path. The regulating portion may include a sealing portion configured to seal the arrangement groove to fix the arrangement module. The arrangement module may include (i) an inlet hole that fluidly communicates with the delivery path or the fixed path and that is configured to supply the oil into the delivery path or the fixed path, and (ii) a guide hole configured to discharge the supplied oil to the delivery path or the fixed path. The shielding portion may be configured to block the inlet hole. The shielding portion may include (i) a main head configured to block the inlet hole, and (ii) a shielding pin extended from the main head. The elastic portion may include a spring configured to receive the shielding pin and bias the main head. The regulating portion may include (i) a sealing portion engaged with the arrangement groove and configured to fix the arrangement module, and (ii) a grasp portion extended from the sealing portion or the arrangement module and configured to receive the shielding pin and permit the shielding pin to reciprocate. The grasp portion may be configured to mount the spring. The grasp portion may be extended from the sealing portion to the inlet hole. The arrangement module may include an insertion hole configured to receive the grasp portion. The insertion hole may fluidly communicate with the inlet hole. The shielding pin may have a length longer than a length of the main head disposed at a free end of the grasp portion. The shielding portion may include a step difference head extended from the main head and having a diameter smaller than a diameter of the main head. The shielding portion may be configured to be inserted into the inlet hole. The regulating portion may be configured to open or close the fixed path. The regulating portion may be configured to selectively block the opening of the delivery path or the fixed path. The compressor may include a case. The driving unit may be included in the case. The case may have a discharge outlet for discharging the refrigerant and an oil storage space for receiving the oil.

To achieve these objects and other advantages and in accordance with the purpose of the present disclosure, as embodied and broadly described herein, a compressor according to the present disclosure is provided, to which a structure for preventing oil from backward flowing is applied by using a principle of a differential pressure formed in an oil supply hole. The structure for preventing oil from backward flowing for a differential pressure structure based on a spring resilience is applied to the compressor. Various types of valves may be applied to the structure for preventing oil from backward flowing.

To achieve these objects and other advantages, the present disclosure provides a structure for preventing oil supply from flowing for stability of oil supply when a compressor is driven at a low pressure ratio.

The present disclosure may provide a compressor based on a spring resilience or a check valve system. The structure for preventing oil from backward flowing may be provided to shield a path when the path is opened through a differential pressure by a high pressure area but a pressure ratio is reduced.

To achieve these objects and other advantages, the present disclosure may provide a compressor comprising a regulate portion provided in at least one of a main frame and a fixed scroll to control or selectively shield an opening of an oil supply path.

A check valve provided in at least one of the main frame and the fixed scroll to prevent the oil from backward flowing in a delivery path or a fixed path may be applied to the regulate portion.

Also, a normal rotation valve for controlling an opening of the delivery path or the fixed path may be applied to the regulate portion.

Also, a structure of a valve provided in an arrangement groove to reciprocate may be applied to the regulate portion, wherein the arrangement groove is provided to be communicated with an oil supply path in the fixed scroll or the main frame. For example, the regulate portion may include a shielding portion provided to shield the oil supply path, and an elastic portion fixed into the arrangement groove and provided to pressurize the shielding portion toward the delivery path or the fixed path. That is, a structure based on elasticity of a spring and a pressure difference may be applied to the regulate portion.

The regulate portion may further include an arrangement module provided to be inserted into the arrangement groove, and the shielding portion and the elastic portion may be provided in the arrangement module. Therefore, the regulate portion may easily be provided in a compression unit in a module type, and its repair and exchange may be simplified.

According to the present disclosure, a scroll compressor, which may prevent oil supplied to a compression unit from backward flowing, is provided.

According to the present disclosure, a scroll compressor, which is additionally provided with a valve or regulate portion that allows oil supplied to a compression unit to pass but shields backward flowing oil, is provided.

According to the present disclosure, a scroll compressor, which may stably maintain the supply amount of oil even though an orbiting scroll is driven as a path through which oil is supplied is always provided in a fixed component of a case, is provided.

According to the present disclosure, oil may be prevented from backward flowing even though a pressure difference between a high pressure area and a low pressure area of a compression unit is not great.

According to the present disclosure, oil may sufficiently be supplied even though a pressure difference between a high pressure area and a low pressure area of a compression unit is not great.

According to the present disclosure, oil may normally be supplied even though a compression unit is driven at high pressure or low pressure.

It is to be understood that both the foregoing general description and the following detailed description of the present disclosure are exemplary and explanatory and are intended to provide further explanation of the present disclosure as claimed.

BRIEF DESCRIPTION OF THE DRAWINGS

The accompanying drawings, which are included to provide a further understanding of the present disclosure and are incorporated in and constitute a part of this application, illustrate embodiment(s) of the present disclosure and together with the description serve to explain the principle of the present disclosure. In the drawings.

DETAILED DESCRIPTION

Reference will now be made in detail to the detailed embodiments of the present disclosure, examples of which are illustrated in the accompanying drawings. Wherever possible, the same reference numbers will be used throughout the drawings to refer to the same or like parts and their description will be replaced with the first description. The term of a singular expression in this specification should be understood to include a multiple expression as well as the singular expression if there is no specific definition in the context. Also, in description of the embodiment disclosed in this specification, if detailed description of elements or functions known in respect of the present disclosure is determined to make the subject matter of the present disclosure unnecessarily obscure, the detailed description will be omitted. Also, it is to be understood that the accompanying drawings are intended to easily understand the embodiment disclosed in this specification and technical spirits disclosed in this specification should not be restricted by the accompanying drawings.

Figure 1A:
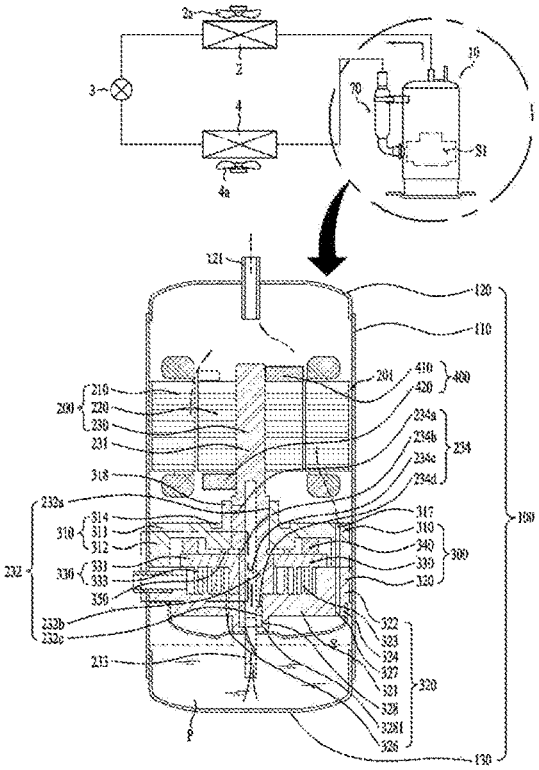
FIGS. 1A and 1B illustrate a structure of a scroll compressor of the related art.
Figure 1B:
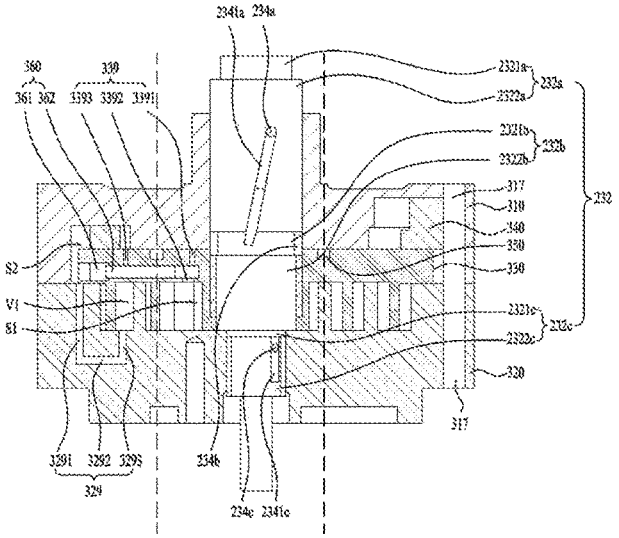
Figure 2:
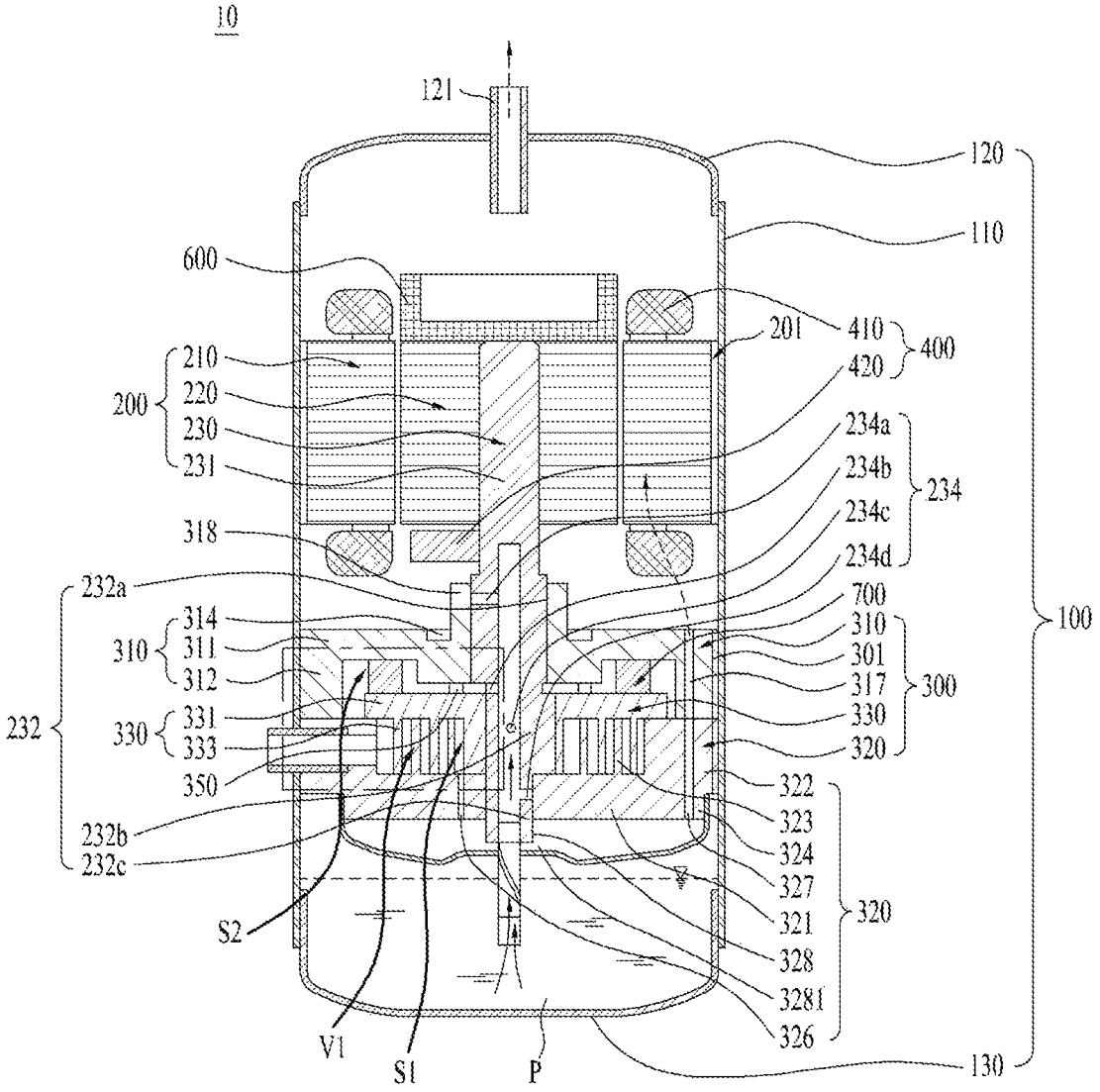
FIG. 2 illustrates a basic structure of a scroll compressor according to one embodiment of the present disclosure.

FIG. 2 illustrates a basic structure of a scroll compressor according to one embodiment of the present disclosure.

Referring to FIG. 2, the scroll compressor 10 according to one embodiment of the present disclosure may include a case 100 having a space where a fluid is stored or moves, a driving unit 200 coupled to an inner circumferential surface of the case 100, rotating a rotary shaft 230, and a compression unit 300 coupled with the rotary shaft 230 in the case and provided to compress the fluid.

In detail, the case 100 may be provided with a discharge outlet 121 at one side, through which a refrigerant is discharged. The case 100 may include an accommodating shell 110 provided in a cylindrical shape, accommodating the driving unit 200 and the compression unit 300, a discharge shell 120 coupled to one end of the accommodating shell 110 and provided with the discharge outlet 121, and a shielding shell 130 coupled to the other end of the accommodating shell 110, shielding the accommodating shell 110.

The driving unit 200 includes a stator 210 generating a rotating electric field, and a rotor 220 provided to be rotated by the rotating electric field, and the rotary shaft 230 may be provided to be coupled to the rotor 220 and rotated with the rotor 220.

The stator 210 may be provided with a plurality of slots formed on its inner circumferential surface along a circumferential direction to wind coils in the slots, and may be fixed to the inner circumferential surface of the accommodating shell 110. The rotor 220 may be provided to be coupled with a permanent magnet and rotatably coupled in the stator 210 to generate a rotating power. The rotary shaft 230 may be coupled to the center of the rotor 220 by press fitting.

The compression unit 300 may include a fixed scroll 320 coupled to the accommodating shell 110 and provided in the driving unit 200 to be far away from the discharge outlet 121, an orbiting scroll 330 coupled with the rotary shaft 230, forming a compression chamber by being engaged with the fixed scroll 320, and a main frame 310 accommodating the orbiting scroll 330, mounted in the fixed scroll 320 to form an external appearance of the compression unit 300.

Consequently, in the lower scroll compressor 10, the driving unit 200 is arranged between the discharge outlet 121 and the compression unit 300. In other words, the driving unit 200 may be provided at one side of the discharge outlet 121, and the compression unit 300 may be provided in the driving unit 200 to be far away from the discharge outlet 121. For example, if the discharge outlet 121 is provided above the case 100, the compression unit 300 may be provided below the driving unit 200, and the driving unit 200 may be provided between the discharge outlet 121 and the compression unit 300.

As a result, if oil is stored in the case 100, the oil may directly be supplied to the compression unit 300 without passing through the driving unit 200. Also, as the rotary shaft 230 may be supported by being coupled to the compression unit 300, a lower frame rotatably supporting the rotary shaft may be omitted.

Meanwhile, the lower scroll compressor 10 of the present disclosure may be provided such that the rotary shaft 230 is in surface contact with the orbiting scroll 330 and the fixed scroll 320 by passing through the fixed scroll 320 as well as the orbiting scroll 330.

For this reason, an inflow force generated when a fluid such as a refrigerant enters the compression unit 300, a gas power generated when the refrigerant is compressed in the compression unit 300 and a repulsive force supporting the gas power may act on the rotary shaft 230 as they are. Therefore, the inflow force, the gas power and the repulsive force may act on the rotary shaft 230 at one action point. As a result, since a tilting moment does not act on the orbiting scroll 330 coupled to the rotary shaft 230, the orbiting scroll may fundamentally be shielded from tilting. In other words, axial vibration from vibration generated from the orbiting scroll 330 may be attenuated or avoided, and the tilting moment of the orbiting scroll 330 may also be attenuated or suppressed. For this reason, noise and vibration generated from the lower scroll compressor 10 may be shielded.

Also, since the fixed scroll 320 supports the rotary shaft 230 through surface contact, even though the inflow force and the gas power act on the rotary shaft 230, durability of the rotary shaft 230 may be enhanced.

Also, a back pressure generated when the refrigerant is discharged out is partially absorbed or supported by the rotary shaft 230, whereby a force (normal force) where the orbiting scroll 330 and the fixed scroll 320 are closely attached to each other in a shaft direction may be reduced. As a result, a frictional force between the orbiting scroll 330 and the fixed scroll 320 may be reduced remarkably.

Consequently, the compressor 10 may attenuate axial movement and tilting moment of the orbiting scroll 330 in the compression unit 300, and may improve efficiency and reliability of the compression unit 300 by reducing the frictional force of the orbiting scroll.

Meanwhile, the main frame 310 of the compression unit 300 may include a main end plate 311 provided at one side of the driving unit 200 or below the driving unit 200, a main side plate 312 extended from an inner circumferential surface of the main end plate 311 to be far away from the driving unit 200 and mounted in the fixed scroll 330, and a main bearing portion 318 extended from the main end plate 311, rotatably supporting the rotary shaft 230.

A main hole guiding the refrigerant discharged from the fixed scroll 320 to the discharge outlet 121 may further be provided in the main end plate 311 or the main side plate 312.

The main end plate 311 may further include an oil pocket 314 formed to be embossed outside the main bearing portion 318. The oil pocket 314 may be provided in a ring shape, and may be provided to be eccentric from the main bearing portion 318. The oil pocket 314 may be provided to be supplied to a portion where the fixed scroll 320 and the orbiting scroll 330 are engaged with each other, if the oil stored in the shielding shell 130 is delivered through the rotary shaft 230.

The fixed scroll 320 may include a fixed end plate 321 provided to be coupled with the accommodating shell 110 in the main end plate 311 to be far away from the driving unit 200, forming the other surface of the compression unit 300, a fixed side plate 322 extended from the fixed end plate 321 to the discharge outlet 121 and provided to be in contact with the main side plate 312, and a fixed wrap 323 provided on an inner circumferential surface of the fixed side plate 322, forming a compression chamber where the refrigerant is compressed.

The fixed scroll 320 may include a fixed through hole 328 provided to allow the rotary shaft 230 to pass therethrough, and a fixed bearing portion 3281 extended from the fixed through hole 328 and supported to rotate the rotary shaft. The fixed bearing portion 3281 may be provided at the center of the fixed end plate 321.

A thickness of the fixed end plate 321 may be provided to be the same as that of the fixed bearing portion 3281. At this time, the fixed bearing portion 3281 may be provided to be inserted into the fixed through hole 328 without being extended to the fixed end plate 321.

The fixed side plate 322 may be provided with an inflow hole 325 for flowing the refrigerant into the fixed wrap 323, and the fixed end plate 321 may be provided with a discharge hole 326 through which the refrigerant is discharged. The discharge hole 326 may be provided in a center direction of the fixed wrap 323 but may be provided to be spaced apart from the fixed bearing portion 3281 to avoid interference with the fixed bearing portion 3281. Also, a plurality of discharge holes 326 may be provided.

The orbiting scroll 330 may include an orbiting end plate 331 provided between the main frame 310 and the fixed scroll 320, and an orbiting wrap 333 forming a compression chamber together with the fixed wrap 323 in the orbiting end plate.

The orbiting scroll 330 may further include an orbiting through hole 338 provided to pass through the orbiting end plate 331 to allow the rotary shaft 230 to be rotatably coupled therewith.

The rotary shaft 230 may be provided such that a portion coupled to the orbiting through hole 338 may be eccentric. Therefore, if the rotary shaft 230 is rotated, the orbiting scroll 330 may compress the refrigerant while moving along the fixed wrap 323 of the fixed scroll 320 by being engaged with the fixed wrap 323.

In detail, the rotary shaft 230 may include a main shaft 231 rotated by being coupled to the driving unit 200, and a bearing portion 232 connected to the main shaft 231 and rotatably coupled with the compression unit 300. The bearing portion 232 may be provided separately from the main shaft 231, and therefore may be provided to accommodate the main shaft 231 therein or provided in a single body with the main shaft 231.

The bearing portion 232 may include a main bearing portion 232*c* inserted into the main bearing portion 318 of the main frame 310 and provided to be rotatably supported, a fixed bearing portion 232*a* inserted into the fixed bearing portion 3281 of the fixed scroll 320 and provided to be rotatably supported, and an eccentric shaft 232*b* provided between the main bearing portion 232*c* and the fixed bearing portion 232*a*, inserted into the orbiting through hole 338 of the orbiting scroll 330 and provided to be rotatably supported.

At this time, the main bearing portion 232*c* and the fixed bearing portion 232*a* may be formed on the same shaft line to have the same shaft center, and the eccentric shaft 232*b* may be formed such that center of gravity is to be eccentric in a radius direction with respect to the main bearing portion 232*c* or the fixed bearing portion 232*a*. Also, an outer diameter of the eccentric portion 232*b* may be formed to be greater than that of the main bearing portion 232*c* or the fixed bearing portion 232*a*. Therefore, the eccentric shaft 232*b* may provide a force for compressing the refrigerant while orbiting the orbiting scroll 330 when the bearing portion 232 is rotated, and the orbiting scroll 330 may be provided to regularly orbit in accordance with the eccentric shaft 232*b*.

However, in order to prevent the orbiting scroll 330 from rotating, the compressor 10 of the present disclosure may further include an Oldham's ring 340 coupled to an upper portion of the orbiting scroll 330. The Oldham's ring 340 may be provided between the orbiting scroll 330 and the main frame 310 to be in contact with the orbiting scroll 330 and the main frame 310. The Oldham's ring 340 may be provided to perform linear motion in four directions of forward, backward, left and right sides, whereby rotation of the orbiting scroll 320 may be avoided.

Meanwhile, the rotary shaft 230 may be provided to fully pass through the fixed scroll 320 and therefore provided to be protruded to the outside of the compression unit 300. As a result, the rotary shaft 230 may directly be in contact with the outside of the compression unit 300 and the oil stored in the shielding shell 130, and may supply the oil to the inside of the compression unit 300 while rotating.

The oil may be supplied to the compression unit 300 through the rotary shaft 230. An oil supply path 234 for supplying the oil to an outer circumferential surface of the main bearing portion 232*c*, an outer circumferential surface of the fixed bearing portion 232*a*, and an outer circumferential surface of the eccentric shaft 232*b* may be formed in the rotary shaft 230 or inside the rotary shaft 230.

Also, a plurality of oil supply holes 234*a*, 234*b*, 234*c* and 234*d* may be formed in the oil supply path 234. In detail, the oil supply holes may include the first oil supply hole 234*a*, the second oil supply hole 234*b*, the third oil supply hole 234*c* and the fourth oil supply hole 234*d*. First of all, the first oil supply hole 234*a* may be formed to pass through the outer circumferential surface of the main bearing portion 232*c*.

The first oil supply hole 234*a* may be formed to pass through the outer circumferential surface of the main bearing portion 232*c* from the oil supply path 234. Also, the first oil supply hole 234*a* may be formed to pass through, but not limited to, an upper portion of the outer circumferential surface of the main bearing portion 232*c*. That is, the first oil supply hole 234*a* may be formed to pass through a lower portion of the outer circumferential surface of the main bearing portion 232*c*. For reference, unlike the shown drawing, the first oil supply hole 234*a* may include a plurality of holes. Also, if the first oil supply hole 234*a* includes a plurality of holes, each hole may be formed on only the upper portion or the lower portion of the outer circumferential surface of the main bearing portion 232*c*, or may respectively be formed on the upper portion and the lower portion of the outer circumferential surface of the main bearing portion 232*c*.

Also, the rotary shaft 230 may include an oil feeder 233 provided to be in contact with the oil stored in the case by passing through a muffler 500 which will be described later. The oil feeder 233 may include an extension shaft 233*a* which is in contact with the oil by passing through the muffler 500 and a screw groove 233*b* provided on an outer circumferential surface of the extension shaft 233*a* in a screw shape and communicated with the oil supply path 234.

Therefore, if the rotary shaft 230 is rotated, the oil ascends through the oil feeder 233 and the oil supply path 234 due to viscosity of the oil and the screw groove 233*b* and the pressure difference between the high pressure area S1 and the intermediate pressure area V1 in the compression unit 300, and is discharged to the plurality of oil supply holes. The oil discharged through the plurality of oil supply holes 234*a*, 234*b*, 234*c* and 234*d* may not only maintain an airtight state by forming an oil film between the fixed scroll 320 and the orbiting scroll 330 but also be provided to absorb and emit friction heat generated in a frictional portion between the components of the compression unit 300.

The oil guided along the rotary shaft 230 and supplied through the first oil supply hole 234*a* may be provided to lubricate the main frame 310 and the rotary shaft 230. Also, the oil may be discharged through the second oil supply hole 234*b* and supplied to an upper surface of the orbiting scroll 330. The oil supplied to the upper surface of the orbiting scroll 330 may be guided to an intermediate pressure chamber through a pocket groove 314. For reference, the oil discharged through the first oil supply hole 234*a* or the third oil supply hole 234*c* as well as the second oil supply hole 234*b* may be supplied to the pocket groove 314.

Meanwhile, the oil guided along the rotary shaft 230 may be supplied to the Oldham's ring 340 provided between the orbiting scroll 330 and the main frame 310 and the fixed side plate 322 of the fixed scroll 320. As a result, abrasion of the fixed side plate 322 of the fixed scroll 320 and the Oldham's ring 340 may be reduced. Also, the oil supplied to the third oil supply hole 234*c* may be supplied to the compression chamber, whereby abrasion caused by friction between the orbiting scroll 330 and the fixed scroll 320 may be reduced, an oil film may be formed, and compression efficiency may be improved by heat emission.

Although a centrifugal oil supply structure for supplying oil to a bearing through rotation of the rotary shaft 230 in the scroll compressor 10 has been described as above, the structure is only exemplary. A differential pressure oil supply structure for supplying oil through a pressure difference in the compression unit 300 and a forcible oil supply structure for supplying oil through a trochoid pump may be applied to the present disclosure.

Meanwhile, the compressed refrigerant is discharged to the discharge hole 326 along a space formed by the fixed wrap 323 and the orbiting wrap 333. The discharge hole 326 may be provided toward the discharge outlet 121 more preferably. This is because that it is most preferable to deliver the refrigerant discharged from the discharge hole 326 to the discharge outlet 121 without a big change of a moving direction.

However, the discharge hole 326 is provided to spray the refrigerant in an opposite direction of the discharge outlet 121 due to structural characteristics that the compression unit 300 should be provided in the driving unit 200 to be far away from the discharge outlet 121 and the fixed scroll 320 should be provided at the outmost portion of the compression unit 300.

In other words, the discharge hole 326 is provided in the fixed end plate 321 to spray the refrigerant to be far away from the discharge outlet 121. Therefore, if the refrigerant is sprayed to the discharge hole 326 as it is, the refrigerant may not be discharged to the discharge outlet 121 smoothly, and if the oil is stored in the shielding shell 130, the refrigerant may be cooled or mixed with the oil due to collision with the oil.

To avoid this, the compressor 10 of the present disclosure may further include a muffler 500 coupled to the outmost portion of the fixed scroll 320, providing a space for guiding the refrigerant to the discharge outlet 121.

The muffler 500 may be provided to seal one surface of the fixed scroll 320, which is provided to be far away from the discharge outlet 121, whereby the refrigerant discharged from the fixed scroll 320 may be guided to the discharge outlet 121.

The muffler 500 may include a coupling body 520 coupled to the fixed scroll 320, and an accommodating body 510 extended from the coupling body 520 to form a sealed space. Therefore, the refrigerant sprayed from the discharge hole 326 may be discharged to the discharge outlet 121 by switching a moving direction along the sealed space formed by the muffler 500.

Meanwhile, since the fixed scroll 320 is provided to be coupled to the accommodating shell 110, the refrigerant may be disturbed by the fixed scroll 320 and therefore prohibited from moving to the discharge outlet 121. Therefore, the fixed scroll 320 may further include a bypass hole 327 that allows the refrigerant to pass through the fixed scroll 320 by passing through the fixed end plate 321. The bypass hole 327 may be provided to be communicated with the main hole. As a result, the refrigerant may be discharged to the discharge hole 326 by passing through the compression unit 300 and the driving unit 200.

Since the refrigerant is compressed at higher pressure when moving from the outer circumferential surface of the fixed wrap 323 to the inside of the fixed wrap 323, the insides of the fixed wrap 323 and the orbiting wrap 333 are maintained at a high pressure state. Therefore, a discharge pressure acts on a rear surface of the orbiting scroll as it is, and a back pressure acts on the fixed scroll from the orbiting scroll as a reaction. The compressor 10 of the present disclosure may further include a back pressure seal 350 that prevents leakage between the orbiting wrap 333 and the fixed wrap 323 from occurring by concentrating the back pressure on a portion where the orbiting scroll 320 and the rotary shaft 230 are coupled with each other.

The back pressure seal 350 is provided in a ring shape, maintains its inner circumferential surface at a high pressure, and separates its outer circumferential surface into an intermediate pressure lower than the high pressure. Therefore, the back pressure is concentrated on the inner circumferential surface of the back pressure seal 350, whereby the orbiting scroll 330 is closely attached to the fixed scroll 320.

At this time, considering that the discharge hole 326 is spaced apart from the rotary shaft 230, the back pressure seal 350 may be provided such that its center is inclined toward the discharge hole 326.

Also, the oil supplied from the first oil supply hole 234*a* may be supplied to the inner circumferential surface of the back pressure seal 350 due to the back pressure seal 350. Therefore, the oil may lubricate a contact surface between the main scroll and the orbiting scroll. Moreover, the oil supplied to the inner circumferential surface of the back pressure seal 350 may form a back pressure for pushing the orbiting scroll 330 to the fixed scroll 320 together with some of the refrigerant.

As a result, a compression space of the fixed wrap 323 and the orbiting wrap 333 may be categorized into a high pressure area S1 of an inner area of the back pressure seal 350 and an intermediate pressure area V1 of an outer area of the back pressure seal 350 based on the back pressure seal 350. Since the pressure is increased while the refrigerant is being compressed, the high pressure area S1 and the intermediate pressure area V1 may naturally be identified from each other. However, since a pressure change may occur critically due to the presence of the back pressure seal 350, the compression space may be identified due to the back pressure seal 350.

Meanwhile, the oil supplied to the compression unit 300 or the oil stored in the case 100 may move to the upper portion of the case 100 together with the refrigerant as the refrigerant is discharged to the discharge outlet 121. At this time, since the oil has density greater than that of the refrigerant, the oil is attached to inner walls of the discharge shell 120 and the accommodating shell 110 without moving to the discharge outlet 121 due to a centrifugal force generated by the rotor 220. The lower scroll compressor 10 may further include a recovery path formed on outer circumferential surfaces of the driving unit 200 and the compression unit 300 to recover the oil attached to the inner wall of the case 10 to the oil storage space or the shielding shell 130 of the case 100.

The recovery path may include a driving recovery path 201 provided on the outer circumferential surface of the driving unit 200, a compression recovery path 301 provided on the outer circumferential surface of the compression unit 300, and a muffler recovery path 501 provided on the outer circumferential surface of the muffler 500.

The driving recovery path 201 may be provided as the outer circumferential surface of the stator 210 is partially recessed, and the compression recovery path 301 may be provided as the outer circumferential surface of the fixed scroll 320 is partially recessed. Also, the muffler recovery path 501 may be provided as the outer circumferential surface of the muffler is partially recessed. The driving recovery path 201, the compression recovery path 301 and the muffler recovery path 501 may be provided to be communicated with one another, whereby the oil may pass through the paths.

As described above, since the rotary shaft 230 is provided such that its center of gravity is inclined toward one side due to the eccentric shaft 232*b*, unbalanced eccentric moment may occur during rotation, whereby overall balance may be broken. Therefore, the lower scroll compressor 10 of the present disclosure may further include a balancer 400 that may counterbalance an eccentric moment that may occur due to the eccentric shaft 232*b*.

Since the compression unit 300 is fixed to the case 100, the balancer 400 is preferably coupled to the rotary shaft 230 or the rotor 220, which is provided to be rotated. Therefore, the balancer 400 may include a center balancer 410 provided on a lower end of the rotor 220 or one surface headed for the compression unit 300 to counterbalance or reduce eccentric load of the eccentric shaft 232*b*, and an outer balancer 420 coupled to an upper end of the rotor 220 or the other surface headed for the discharge outlet 121 to counterbalance eccentric load or eccentric moment of any one of the eccentric shaft 232*b* and the lower balancer 420.

Since the center balancer 410 is provided to be relatively close to the eccentric shaft 232*b*, it is advantageous that eccentric load of the eccentric shaft 232*b* may directly be counterbalanced. Therefore, the center balancer 410 is preferably provided to be eccentric in an opposite direction of an eccentric direction of the eccentric shaft 232*b*. As a result, even through the rotary shaft 230 is rotated at low speed or high speed, since the rotary shaft 230 is close to a distance spaced apart from the eccentric shaft 232*b*, an eccentric force or eccentric load generated almost uniformly by the eccentric shaft 232*b* may be counterbalanced effectively.

The outer balancer 420 may be provided to be eccentric in an opposite direction of the eccentric direction of the eccentric shaft 232*b*. However, the outer balancer 420 may be provided to be eccentric in a direction corresponding to the eccentric shaft 232*b*, thereby partially counterbalancing eccentric load generated by the center balancer 410.

As a result, the center balancer 410 and the outer balancer 420 may assist stable rotation of the rotary shaft 230 by counterbalancing the eccentric moment generated by the eccentric shaft 232*b*.

Figure 3:
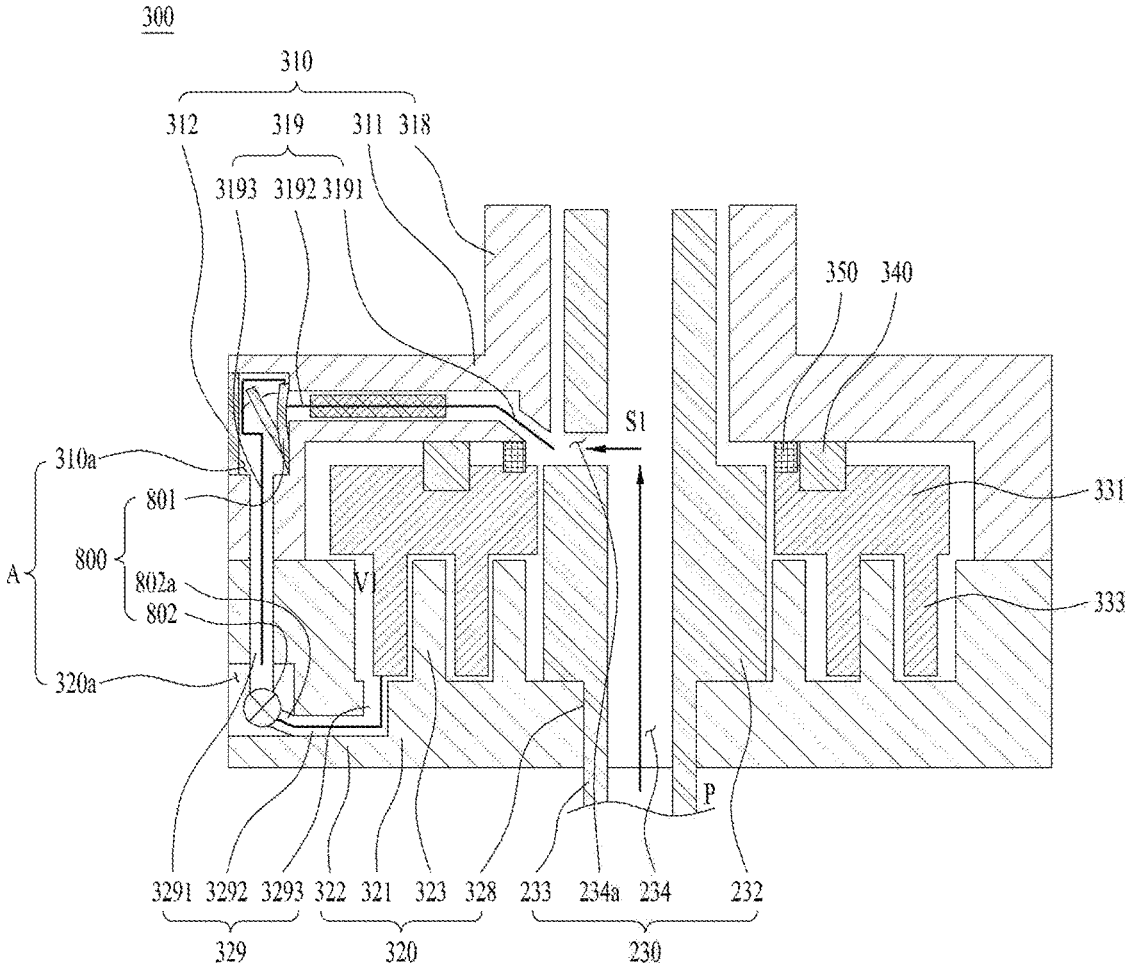
FIG. 3 illustrates an example of a regulate portion that may prevent oil from backward flowing.

FIG. 3 illustrates a structure of lubricant oil supplied to a compressor of the present disclosure and a structure of a regulate portion that prevents oil from backward flowing.

The compression unit may include a delivery path 319 provided in at least one of the orbiting scroll 330 and the main scroll, allowing oil supplied from the oil supply path 234 to move therethrough, and a fixed path 329 provided in the fixed scroll to be communicated with the delivery path, supplying the oil between the orbiting scroll 330 and the fixed scroll. The delivery path and the fixed path may form an oil supply path through which the oil supplied through the rotary shaft 230 is supplied to the compression chamber by a pressure difference.

In the compression unit 300 of the compressor according to the present disclosure, the delivery path 319 may be provided in the main frame not the orbiting scroll. The delivery path 319 may be provided in the main frame fixed to the case 100 and therefore its position may always be fixed. Therefore, the oil may stably enter the delivery path 319, and may stably be delivered to the fixed path 329. Also, the amount of the oil supplied through the delivery path 319 may be controlled more easily.

The delivery path 319 may include a main path 3191 supplied with oil by passing through the main bearing portion 318, a pass through path 3192 extended from the main path 3191 to an outer circumferential surface along the main end plate 311 to allow the oil to pass therethrough, and a discharge path 3193 connected to an end of the pass through path 3192 and extended to the fixed scroll 320 to discharge the oil.

The main path 3191 may be provided in parallel with a space between the main end plate 311 of the main frame and the orbiting end plate 331 of the orbiting scroll. As a result, the oil discharged from the first oil supply hole 241*a* may enter between the main end plate 311 and the orbiting end plate 331 and then may be supplied to the back pressure seal 350, and at the same time may enter the main path 3191.

Since the main frame 310 is always fixed to the case 100, if the delivery path 319 is provided in the main frame 310, the oil may stably be supplied to the fixed scroll 320.

Meanwhile, the fixed path 329 may include an inflow path 3291 provided in the fixed side plate to be communicated with the discharge path 3193, allowing the oil supplied to the delivery path to enter there, and a supply path 3292 provided in the fixed end plate to be communicated with the inflow path 3291, moving the oil supplied to the inflow path to the fixed wrap 332.

At this time, since the fixed path 329 should supply the oil to the outer circumferential surface of the fixed wrap 323, the inflow path 3291 may be provided to be extended from the fixed side plate at a length corresponding to a thickness of the fixed wrap 323 or longer than the thickness of the fixed wrap 323. Also, the supply path 3292 may be extended from the inflow path 3291 to the inner circumferential surface of the outmost portion of the fixed wrap 323. The inflow path 3291 where the refrigerant enters may be provided to be communicated with the outmost surface of the fixed wrap 323. The outermost surface of the fixed wrap 323 is a portion that starts to be engaged with the orbiting wrap 333.

If the inflow path 3291 is provided to be extended at a length longer than the thickness of the fixed wrap 323, the fixed path 329 may further include a lubricating path 3293 provided to be extended from the supply path 3292 to the portion directly communicated with the fixed wrap 323 or the inner side of the fixed end plate 321. The inflow path 3291 and the lubricating path 3293 may be provided in parallel, and the supply path 3292 may be provided to be orthogonal or inclined with respect to the inflow path based on the lubricating path.

Therefore, since one end of the delivery path 319 or the inlet path 3391 is located in the high pressure area S1 and the fixed path 329 is located in the intermediate pressure area V1, the oil supplied from the first oil supply hole 234*a* by the pressure difference may be delivered to the fixed path 329 while entering the delivery path 319. Therefore, the oil may be delivered to the fixed wrap 323 to lubricate the orbiting wrap 333 and the fixed wrap 323.

Meanwhile, the back pressure seal 350 may be provided in the Oldham's ring 350, and may be provided to prevent the oil supplied from the rotary shaft 230 from fully leaking between the main frame 310 and the orbiting scroll 330. The back pressure seal 350 may serve to guide the oil from the rotary shaft 230 to be delivered to the main path 3191.

If the orbiting scroll 330 orbits at high speed, the pressure difference between the high pressure area S1 and the intermediate pressure area V1 may be increased significantly, and the oil may excessively be supplied to the fixed wrap 323 and the orbiting wrap 333. For this reason, a problem may occur in that mass oil may be diluted in the refrigerant, the fixed wrap 323 and the orbiting wrap 333 may be cooled by the oil, or oil supply to the fixed wrap 323 may be stopped.

To solve this problem, the compressor according to one embodiment of the present disclosure, a decompression unit 360 that may reduce the pressure difference between the high pressure area and the low pressure area may be provided in the delivery path 319 or the fixed path 329. The decompression unit 360 may be inserted into the delivery path or the fixed path to reduce a diameter of the path, thereby enhancing path resistance. Also, the decompression unit 360 may enhance path resistance by maximizing a frictional force with the oil. Therefore, the pressure difference between the high pressure area S1 and the intermediate pressure area V1 may partially be compensated by the decompression unit 360, whereby the oil may be prevented from being excessively supplied to the fixed wrap 323 and the orbiting wrap 333.

Since the decompression unit 360 should be provided to be inserted into the delivery path or the fixed path, the main frame 310 or the fixed scroll 320 may further include an insertion hole provided to allow the decompression unit 360 to be inserted thereinto by being communicated with the outside of the compression unit 300.

Meanwhile, the inflow path 3291 is provided in the fixed scroll 320 and therefore has excellent durability, and is a portion where oil enters the intermediate pressure area V1 provided in the fixed scroll 320. Therefore, unlike the shown drawing, the decompression unit 360 may be provided to be inserted into the inflow path 3291. As a result, the decompression unit may ensure stability even in case of external impact or vibration, and may immediately control the amount of oil supplied to the intermediate pressure area V1.

The compressor 10 of the present disclosure may discharge the refrigerant to the compression unit 300 at high pressure by rotating the rotary shaft 230 at high speed. However, the compressor 10 of the present disclosure may discharge the refrigerant to the compression unit 300 at relatively low pressure by rotating the rotary shaft 230 at low speed.

If the refrigerant is compressed by the compression unit 300 at low pressure and then discharged, a performance coefficient of a cooling cycle may be increased, and noise and vibration may be reduced. However, the pressure difference between the high pressure area S1 near the rotary shaft 230 and the intermediate pressure area V1 near the fixed side plate 322 may be reduced correspondingly.

Therefore, since the differential pressure of the high pressure area S1 and the intermediate pressure area V1 is not great, the oil supplied from the rotary shaft 230 may not be supplied from the delivery path 319 or the fixed path 329 smoothly, or the oil may be stopped being supplied or may backward flow. Also, since the differential pressure between the intermediate pressure area V1 and the high pressure area S1 may more rapidly be reduced due to the decompression unit 360, it may be difficult to supply the oil or the oil may backward flow.

To solve this, the compressor 10 according to one embodiment of the present disclosure may further include a regulate portion 800 provided in at least one of the main frame and the fixed scroll, controlling or selectively shielding an opening of the delivery path or the fixed path. The regulate portion 800 may be controlled by the differential pressure or a moving direction of the oil and therefore provided so as not to require active control.

The regulate portion 800 may be provided to open the delivery path 319 or the fixed path 329 if the differential pressure is maintained at a reference value or more, and may be provided to close the delivery path 319 or the fixed path 329 if the differential pressure is reduced at a reference value or less. Also, the regulate portion 800 may be provided to open the delivery path 319 or the fixed path 329 if the oil is supplied from the delivery path 319 or the fixed path 329 in a forward direction, and may be provided to close the delivery path 319 or the fixed path 329 if the oil backward flows. Therefore, the regulate portion 800 may maintain oil supply to the compression unit 300 by supplying the oil in a forward direction and shielding oil from backward flowing.

The main frame 310 or the fixed scroll 320 of the compressor 10 according to the present disclosure may further include an arrangement groove A for providing a space where the regulate portion 800 may be arranged. The arrangement groove A may be provided on the delivery path 319 or the fixed path 329 and therefore communicated with the delivery path 319 and the fixed path 329. The arrangement groove A may be provided to have a diameter greater than that of the delivery path 319 or the fixed path 329, and may be formed as the outer circumferential surface of the main side plate 312 or the fixed side plate 322 is partially recessed, whereby the regulate portion 800 may easily be arranged and repaired. The compressor 10 according to one embodiment of the present disclosure may further include a sealing portion that prevents the arrangement groove A from being externally exposed by shielding the arrangement groove A.

If the arrangement groove A is provided in the main frame 310, the arrangement groove A may include a main arrangement groove 310*a* provided between an end of the pass through path 3192 and one end of the discharge path 3193. Also, if the arrangement groove A is provided in the fixed scroll 320, the arrangement groove A may include a fixed arrangement groove 320*a* provided between the inflow path 3291 and the moving path 3192.

The regulate portion 800 may include a check valve 801 provided in at least one of the main frame 310 and the fixed scroll 320, preventing the oil from backward flowing in the delivery path 319 or the fixed path 329. The check valve 801 may be provided to close an upstream of the oil in the delivery path 319 or the fixed path 329. As a result, the check valve 801 may prevent the oil from backward flowing.

For example, the check valve 801 may be fixed to an inner wall of the main arrangement groove 310*a*. The check valve 801 may be coupled to an inner wall adjacent to the pass through path 3192 in the main arrangement groove 310*a* and therefore provided in a plate shape extended at a length that may fully shield the pass through path 3192. Also, the check valve 801 may be provided to be in contact with the sealing portion but may be provided to be prevented from being in contact with the discharge path 3193.

Therefore, the check valve 801 may shield the oil of the delivery path 319 and the fixed path 329 from backward flowing by closing the pass through path 3192 if the oil backward flows to the pass through path 3192.

The regulate portion 800 may include a valve 802 for controlling an opening of the delivery path 319 or the fixed path 329. The valve 802 may be provided as a rotation valve and therefore provided to be actively controlled by the regulate portion of the compressor. At this time, the valve 802 may further include a valve pipe 802*a* communicated with the delivery path 319 and the fixed path 329. The valve 802 may be controlled to be opened if the differential pressure is a reference value or more and controlled to be closed if the differential pressure is a reference value or less. Therefore, the oil may be shielded from backward flowing. For example, the valve 802 may be arranged in the fixed arrangement groove 320*a* and provided to be communicated with the inflow path 3291 and the supply path 3292.

Also, the compressor 10 according to one embodiment of the present disclosure may be provided with both the check valve 801 and the valve 802.

Figure 4:
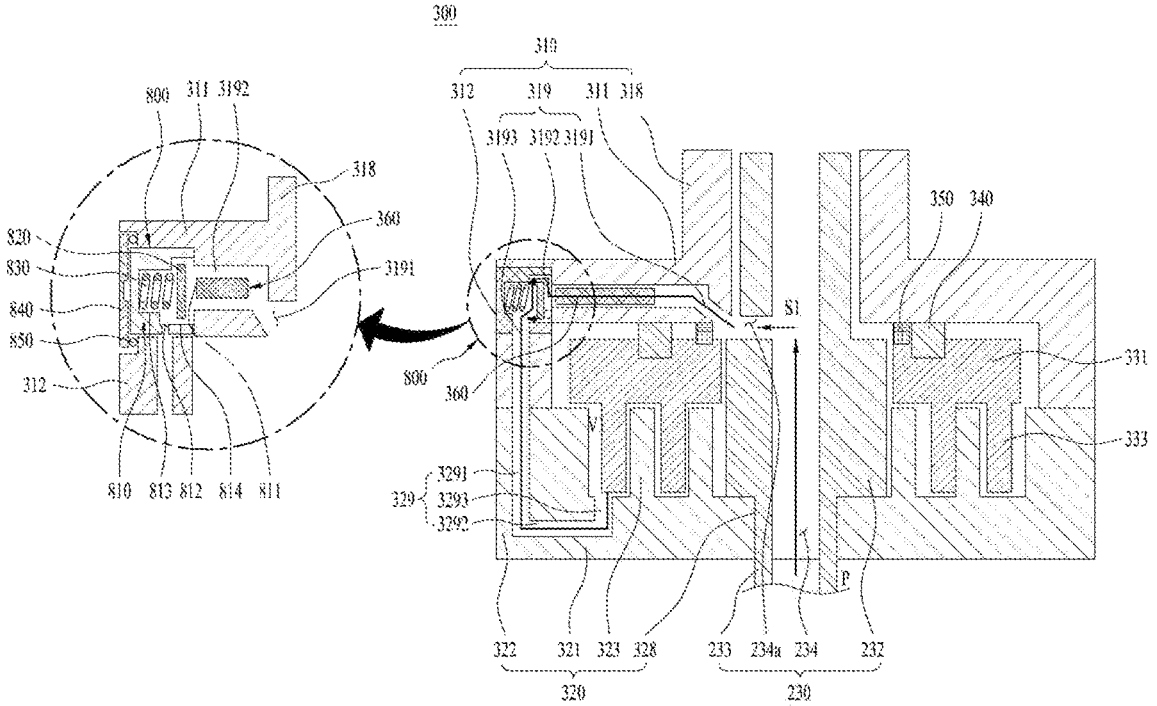
FIG. 4 illustrates another example of the regulate portion.

FIG. 4 illustrates another example of the regulate portion 800 of the present disclosure.

The regulate portion 800 may include a shielding portion 820 provided to reciprocate in the arrangement groove A and provided to shield the delivery path 319 or the fixed path 329, and an elastic portion 830 fixed to the arrangement groove and provided to pressurize the shielding portion toward the delivery path or the fixed path.

The shielding portion 820 may be provided to open the delivery path 319 and the fixed path 329 if the oil starts to enter the main path 3191, and may be provided to close the delivery path 319 and the fixed path 329 if supply of the oil is backflowed.

The elastic portion 830 may be provided to reciprocate the shielding portion 820 in accordance with supply or backward flow of the oil by providing a force for pushing the shielding portion 820 toward the upstream of the delivery path 319 or the fixed path 329.

The arrangement groove A may provide a space where the shielding portion 820 and the elastic portion 830 are provided in the main frame or the fixed scroll. The arrangement groove A may provide a space where the shielding portion 820 and the elastic portion 830 may reciprocate, and may be provided to set a reciprocating direction.

For example, the arrangement groove A may include a moving path 814 through which the shielding portion 820 reciprocates, and an accommodating path 813 extended from the moving path to accommodate the elastic portion therein. The moving path 814 and the accommodating path 813 may be provided in the arrangement groove A in a single body with the main frame or the fixed scroll, or may be provided in a separate arrangement module provided detachably from the main frame or the fixed scroll.

The moving path 814 and the accommodating path 813 may be provided to be communicated with each other, and may be provided to be also communicated with the delivery path 319 and the fixed path 329.

The front of the moving path 814 may be provided with an inlet hole 811 through which oil enters from the delivery path 319 and the fixed path 329, and a side of the accommodating path 813 or the moving path 814 may be provided with a guide hole 812 through which the oil is discharged. Therefore, if the shielding portion 820 opens the inlet hole 811, the oil supplied through the delivery path 319 or the fixed path 329 may enter the inlet hole 811 and then may be discharged to the guide hole 812.

The regulate portion 800 may further include an arrangement module 810 provided to be inserted into the arrangement groove, and the shielding portion 820 and the elastic portion 830 may be provided to be arranged in the arrangement module 810. Therefore, the arrangement module 810 may be inserted into and removed from the arrangement groove A, whereby the regulate portion 800 may simply be provided in the main frame 310 or the fixed scroll 320 or may be exchanged and repaired.

Although FIG. 4 illustrates that the arrangement module 810 is arranged in a portion where the pass through path 3192 and the discharge path 3193 adjoin each other, the arrangement module 810 may be arranged in any one of the delivery path 319 and the fixed path 329. The arrangement module may include the moving path 814 provided to be communicated with the delivery path 319 or the fixed path 329, through which the shielding portion 820 reciprocates, and the accommodating path 813 extended from the moving path, accommodating the elastic portion therein. That is, the moving path 814 and the accommodating path 813 may be formed in the arrangement module 810.

For example, the arrangement module 810 may be provided in a downstream of the pass through path 3192 to face one end of the moving path 814. Also, the arrangement module 810 may be provided to arrange the moving path 814 in parallel with the pass through path 3192.

The accommodating path 813 may be provided to have a diameter smaller than that of the moving path 814. Therefore, the shielding portion 820 may be supported at one end of the accommodating path 813. That is, a reciprocating distance of the shielding portion 820 may be set by the accommodating path 813, and the shielding portion 820 may stably be mounted in the accommodating path 813 even though the oil is supplied at high pressure. The elastic portion 830 may be provided to be compressed or elongated in the accommodating path 813 along the accommodating path 813.

In the arrangement module 810, the inlet hole 811 may be provided at one end of the moving path 814, whereby the oil supplied from the delivery path 319 or the fixed path 329 may be delivered to the inlet hole 811.

For example, the inlet hole 811 may be provided to face the pass through path 3192. The inlet hole 811 may be provided to have a diameter greater than that of the pass through path 3192, and the shielding portion 820 may be provided to have a diameter greater than that of the pass through path 3192. As a result, the oil may be supplied to the inlet hole 811 more smoothly, and the shielding portion 820 may certainly shield the delivery path or the fixed path.

The guide hole 812 may be provided on an outer circumferential surface of the moving path 814 or an outer circumferential surface of the accommodating path 813 to discharge the oil to the delivery path or the fixed path. For example, the guide hole 812 may be provided to be communicated with the discharge path 3193 and therefore provided to deliver the oil supplied to the arrangement module 810 to the fixed path 329. The guide hole 812 may be provided to pass through the outer circumferential surface of the accommodating path 813 or may be provided to pass through the outer circumferential surface of the moving path 814. The guide hole 812 may be provided to pass through the other end of the accommodating path 813 if the oil supplied to the inlet hole 811 is able to be supplied to the delivery path 319 or the fixed path 329.

The inlet hole 811 may be provided to be communicated with the pass through path 3192, and the guide hole 812 may be provide to be communicated with the discharge path 3193.

The regulate portion 800 may further include a sealing portion 840 provided to seal the arrangement groove A, fixing the arrangement module 810. The sealing portion 840 may be provided to form an external appearance of the main frame 310 or the fixed scroll 320, or may be provided to shield the sealing portion 840.

The sealing portion 840 may be provided to pressurize the arrangement module 810, and may be provided to prevent the arrangement module 810 from being externally detached. The sealing portion 840 may be provided in a plate shape and coupled to any one of the main frame 310 and the fixed scroll 320, which is provided with the arrangement groove A, through a fastening member 850. A bolt may be used as the fastening member 850, and the fastening member 850 may be a metal material formed by welding.

The fixed scroll 320 or the main frame 310 may further include a step difference groove having a recessed portion corresponding to the outer circumferential surface of the arrangement groove A to accommodate the sealing portion 840 or allow the fastening member 850 to be provided therein.

Figure 5:
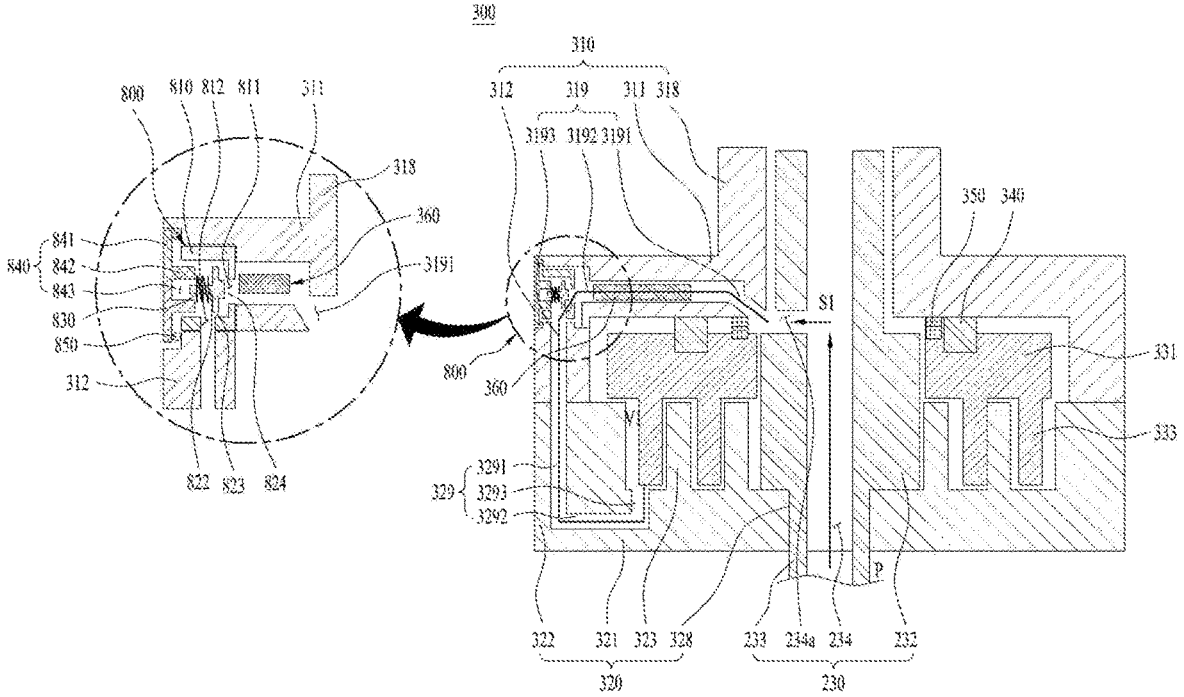
FIG. 5 illustrates still another example of the regulate portion.

FIG. 5 illustrates still another example of the regulate portion according to the present disclosure.

The arrangement module 810 may be provided to form only an inner space without providing the accommodating path or the moving path therein. That is, the shielding portion 820 or the elastic portion 830 may be provided to reciprocate in the inner space of the arrangement module 810.

In detail, the arrangement module 810 may include an inlet hole 811 provided in a case shape to face the delivery path 319 or the fixed path 329 and allow the oil to be supplied thereto, and a guide hole 812 discharging the oil to the delivery path or the fixed path, wherein the inlet hole 811 and the guide hole 812 may be provided to pass through one surface of the arrangement module 810.

The inlet hole 811 may be provided to be communicated with the pass through path 3192, and the guide hole 812 may be provided to be communicated with the discharge path 3193.

The arrangement module 810 may be provided to be closely attached to one end of the delivery path 319 or the fixed path 329, and the inlet hole 811 may be provided to be communicated with the delivery path 319 or the fixed path 329, and may be provided to have a diameter smaller than that of the delivery path 319 or the fixed path 329.

The shielding portion 820 may be provided in the arrangement module 810 to shield the inlet hole 811. The shielding portion 820 shields the inlet hole 811, and may serve to close the delivery path 319 or the fixed path 329.

The shielding portion 820 may include a main head 823 provided to shield the inlet hole 811, and a shielding pin 822 provided to be extended from the main head. The elastic portion 830 may include a spring accommodating the shielding pin 822 to pressurize the main head 823. A force for pressurizing or elongating the elastic portion 830 through the shielding pin 822 may be concentrated toward an extension direction of the shielding pin 822, and the spring may more stably be coupled to the shielding portion 820 through the shielding pin 822.

Also, the shielding portion 820 may further include a step difference head 824 extended from the main head 823 to have a smaller diameter and inserted into the inlet hole 811. The diameter of the step difference head 824 may be provided to correspond to the diameter of the inlet hole 811. As a result, the main head 823 may be closely attached to the inlet hole 811 to seal the inlet hole 811, and the step difference head 824 may seal the inlet hole 811 by closing the inlet hole 811.

The regulate portion 800 may further include a sealing portion 840 coupled to the arrangement groove A, fixing the arrangement module 810. The compressor according to one embodiment of the present disclosure may further include a grasp portion 842 extended from the sealing portion 840 and provided to allow the spring to be mounted therein, accommodating the shielding pin 822 to reciprocate. The sealing portion 840 may include a sealing body 841 provided to shield the insertion hole A, and the grasp portion 842 may be provided to be extended from the sealing body 841 toward the inlet hole 811.

The arrangement module 810 may include an insertion hole opened toward the sealing portion 840, and the grasp portion 842 may be inserted into the insertion hole and provided to accommodate the shielding portion 820. The grasp portion 842 may be provided to face the inlet hole 811 and guide the shielding portion 820 to reciprocate in a direction far away from or close to the inlet hole 811. The grasp portion 842 may be provided in a shape, which may accommodate the shielding pin 822, for example, a pipe shape.

Unlike the shown drawing, the arrangement module 810 may be provided in a case shape, and the grasp portion 842 may be provided to be extended from one surface of the arrangement module 810 toward the inlet hole 811.

Figure 6A:
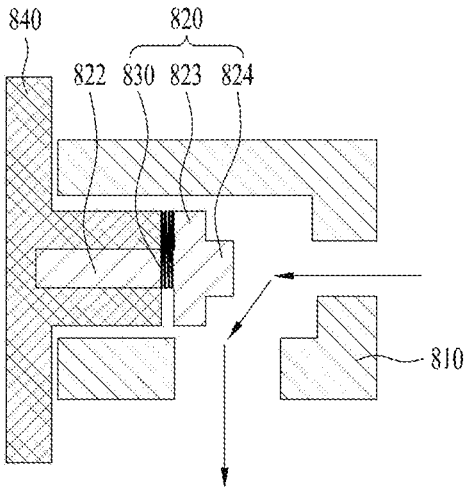
FIGS. 6A and 6B illustrate an operation system of the regulate portion shown in FIG. 5.
Figure 6B:
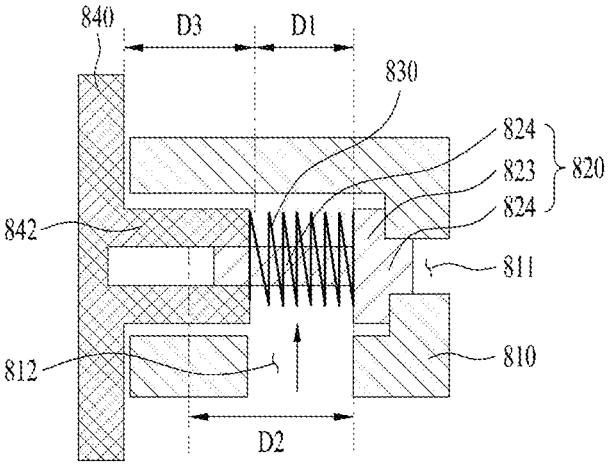

FIGS. 6A and 6B illustrate an operation system of the regulate portion shown in FIG. 5.

Referring to FIG. 6A, if the oil supplied from the oil supply path 234 starts to be supplied due to a great pressure difference between the high pressure area S1 and the intermediate pressure area V1, the elastic portion 830 may be compressed to allow the shielding portion 820 to open the inlet hole 811.

At this time, the elastic portion 830 may have an elastic coefficient K contracted only when the pressure difference is a reference value or more. Therefore, the shielding portion 820 may be provided to open the inlet hole 811 only when the pressure difference is a certain level or more and may prevent the inlet hole 811 from being opened if not desired, and may provide a necessary recovery force. At the same time, if the pressure difference is reduced at a certain level or less, the elastic portion 830 may start to be recovered, and the shielding portion 820 may move to the inlet hole 811.

If the inlet hole 811 is opened, the oil enters the arrangement module 810 or the arrangement groove A and is discharged to the guide hole 812. As a result, the oil may be supplied to the intermediate pressure area V1 through the delivery path 319 and the fixed path 329.

Referring to FIG. 6B, the pressure of the high pressure area S1 may have no great difference with that of the intermediate pressure area V1 or the pressure difference may be a reference value or less or the pressure of the intermediate pressure area V1 may become higher than that of the high pressure area S1. Particularly, if the rotary shaft 230 is rotated at low speed, or if the compressor 10 is driven at a low pressure range, the aforementioned phenomenon may be intensified.

At this time, the elastic portion 830 may be elongated to move the shielding portion 820 to the inlet hole 811, and may be provided to allow the shielding portion 820 to shield the inlet hole 811, the delivery path 319 or the fixed path 329. Therefore, the oil may previously be prevented from backward flowing.

Meanwhile, a length D2 of the shielding pin 822 may be provided to be longer than a length D1 of the inlet hole 811 at a free end of the grasp portion 842. Therefore, the shielding pin 822 may be prevented from being detached from the grasp portion 842. Strictly, it is preferable that the length D2 of the shielding pin 822 is provided to be longer than the length when the main head 823 is closely attached to the inlet hole 811 at the free end of the grasp portion 842.

A sum of a length D3 of the grasp portion 842 extended from the sealing body 841 and the length D1 from the free end of the grasp portion 842 to the inlet hole 811 may be provided to be longer than the D2 of the shielding pin 822. The length D3 of the grasp portion 842 extended from the sealing body 841 may correspond to the length D2 of the shielding pin 822 or may be provided to be longer than the length D2 of the shielding pin 822. As a result, when the elastic portion 830 is compressed at a maximum range, the main head 823 may be supported in the grasp portion 842.

Figure 7:
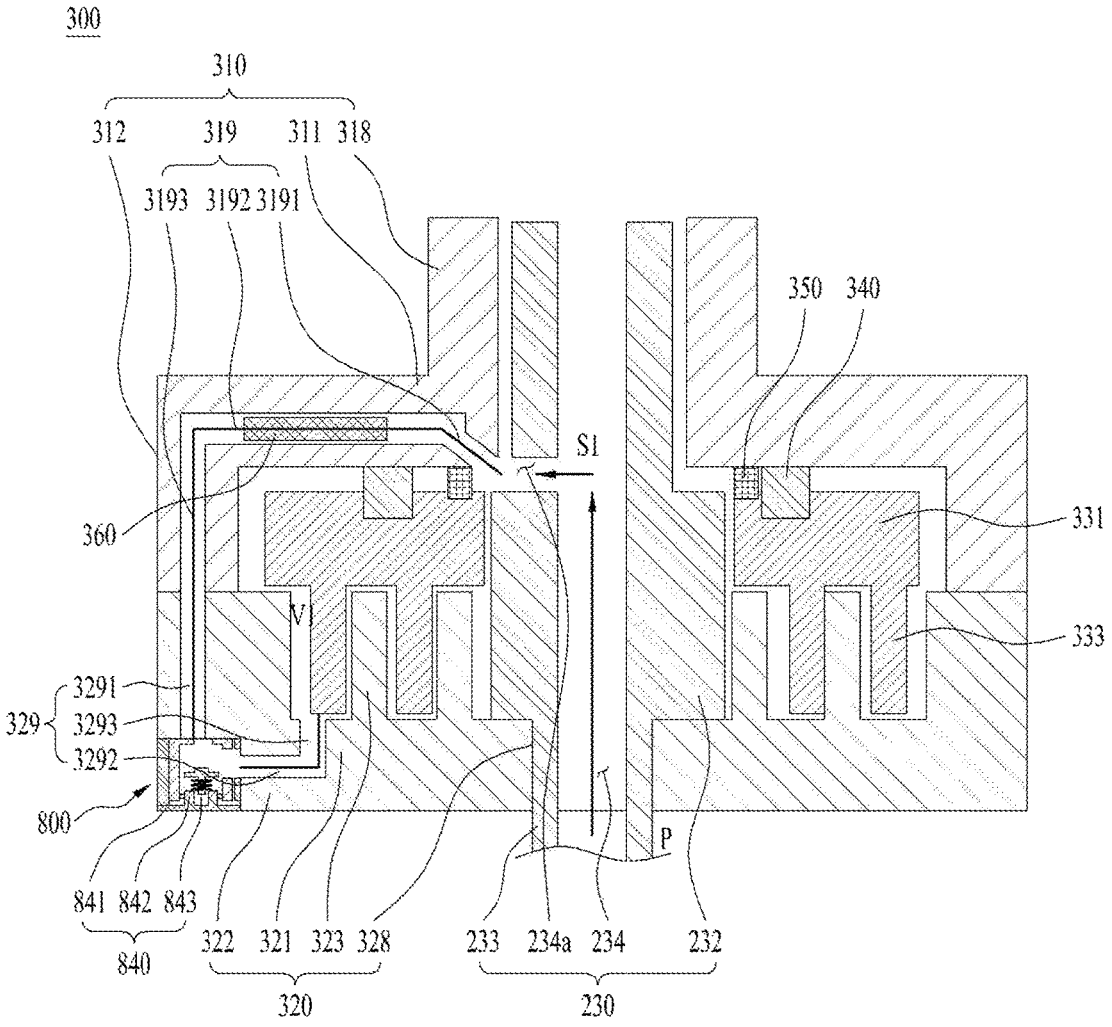
FIG. 7 illustrates a final example of the regulate portion.

FIG. 7 illustrates that the regulate portion 800 is provided in the fixed scroll 320 in accordance with the present disclosure.

As described above, the arrangement groove A may be provided in the fixed scroll 320, and the regulate portion 800 may be provided in the arrangement groove A.

The arrangement groove A may be provided in a portion where the inflow path 3291 is connected with the supply path 3292, and the regulate portion 800 may be provided to communicate the end of the inflow path 3291 with the supply path 3292.

The regulate portion 800 may include a shielding portion 820 that may shield the inflow path 3291 and an arrangement module 810 that accommodates the elastic portion 830 reciprocating the shielding portion 820, wherein the arrangement module 810 may be inserted into the arrangement groove A and fixed to the sealing portion 840.

The arrangement module 810 may include an inflow hole 811 communicated with the inflow path 3291, and a guide hole 812 communicated with the supply path 3292, wherein the inflow hole 811 may be closed and opened by the shielding portion 820.

An internal structure of the arrangement module 810 may be the same as the structure of the arrangement module 810 shown in FIG. 4 or FIG. 5.

Figure 8A:
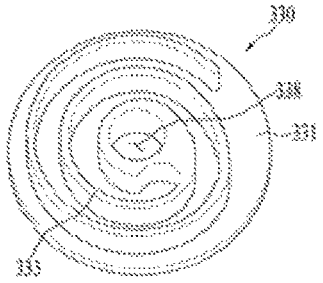
FIGS. 8A to 8C illustrate an operation system of a scroll compressor according to one embodiment of the present disclosure.
Figure 8B:
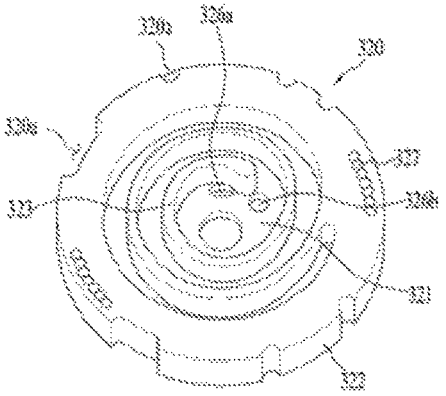
Figure 8C:
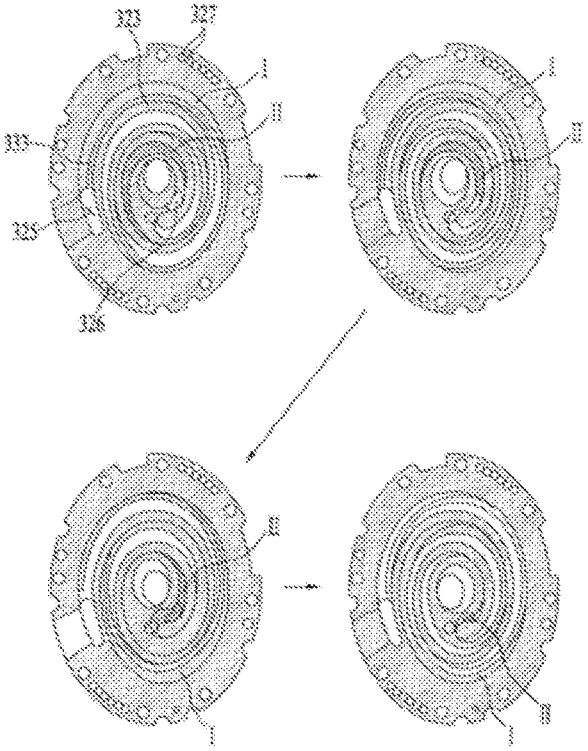

FIGS. 8A to 8C illustrate an operation system of a scroll compressor according to one embodiment of the present disclosure.

FIG. 8A illustrates an orbiting scroll, FIG. 8B illustrates a fixed scroll, and FIG. 8C illustrates a process of compressing a refrigerant by the orbiting scroll and the fixed scroll.

The orbiting scroll 330 may include the orbiting wrap 333 on one surface of the orbiting end plate 331, and the fixed scroll 320 may include the fixed wrap 323 on one surface of the fixed end plate 321.

Also, the orbiting scroll 330 may be provided as a rigid body which is sealed to prevent the refrigerant from being discharged out, while the fixed scroll 320 may include an inflow hole 325 communicated with a refrigerant supply pipe to allow a refrigerant of low temperature and low pressure such as liquid to enter there, and a discharge hole 326 through which the refrigerant of high temperature and high pressure is discharged, and a bypass hole 327 provided on an outer circumferential surface to allow the refrigerant discharged from the discharge hole 326 to be discharged.

Meanwhile, the fixed wrap 323 and the orbiting wrap 333 may be provided in an involute shape and provided to form a compression chamber where the refrigerant is compressed by engagement of at least two points.

The involute shape means a curved line corresponding to a track drawn by an end of a thread wound around a base source having a random radius when the thread is unwound, as shown.

However, the fixed wrap 323 and the orbiting wrap 333 of the present disclosure are formed by combination of 20 or more arcs, and may be provided such that the radius of curvature is varied per portion.

That is, in the compressor of the present disclosure, the rotary shaft 230 may be provided to pass through the fixed scroll 320 and the orbiting scroll 330, whereby the radius of curvature and a compression space of the fixed wrap 323 and the orbiting wrap 333 are reduced.

Therefore, the compressor of the present disclosure may have the radius of curvature of the fixed wrap 323 and the orbiting wrap 333 before the refrigerant is discharged, to be smaller than a passed bearing portion of the rotary shaft, thereby reducing the space where the refrigerant is discharged and improving a compression ratio.

That is, the fixed wrap 323 and the orbiting wrap 333 may be provided to be more curved near the discharge hole 326, and the radius of curvature may be varied per point to correspond to the curved portion as the fixed wrap 323 and the orbiting wrap 333 are extended to the inflow hole 325.

Referring to FIG. 8C, a refrigerant I enters the inflow hole 325 of the fixed scroll 320, and a refrigerant II entering the inflow hole 325 earlier than the refrigerant I is located near the discharge hole 326 of the fixed scroll 320.

At this time, the refrigerant I exists in an area where the fixed wrap 323 and the orbiting wrap 333 are engaged with each other on their outer surfaces, and the refrigerant II exists to be sealed in another area where the fixed wrap 323 and the orbiting wrap 333 are engaged with each other at two points.

Afterwards, if the orbiting scroll 330 starts to orbit, the area where the fixed wrap 323 and the orbiting wrap 333 are engaged with each other at two points moves along the extension direction of the fixed wrap 323 and the orbiting wrap 333 in accordance with position change of the orbiting wrap 333, whereby a volume of the refrigerant starts to be reduced and the refrigerant I moves and starts to be compressed. The volume of the refrigerant II is more reduced and compressed and therefore starts to be guided to the discharge hole 326.

The refrigerant II is discharged from the discharge hole 326, and the refrigerant I moves as the area where the fixed wrap 323 and the orbiting wrap 333 are engaged with each other at two points moves clockwise, and starts to be more compressed by its volume reduction.

As the area where the fixed wrap 323 and the orbiting wrap 333 are engaged with each other at two points again moves clockwise, the area becomes close to the inside of the fixed scroll, and the volume of the refrigerant is more reduced and compressed, whereby the discharge of the refrigerant II is almost completed.

In this way, as the orbiting scroll 330 orbits, the refrigerant may be compressed linearly or continuously while moving to the inside of the fixed scroll.

Although FIGS. 8A to 8C illustrate that the refrigerant enters the inflow hole 325 discontinuously, this is only for description, and the refrigerant may be supplied continuously and compressed by being accommodated per area where the fixed wrap 323 and the orbiting wrap 333 are engaged with each other at two points.

It will be apparent to those skilled in the art that the present disclosure may be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

What is claimed is:

1. A compressor comprising:

a driving unit;

a rotary shaft rotatable by the driving unit and configured to supply oil; and a compression unit coupled to the rotary shaft and configured to compress a refrigerant, the compression unit configured to be lubricated by the oil supplied by the rotary shaft, wherein the compression unit includes:

an orbiting scroll rotatably engaged with the rotary shaft and configured to orbit as the rotary shaft is rotated, a fixed scroll engaged with the orbiting scroll and configured to compress and discharge the refrigerant in cooperation with the orbiting scroll, a main frame connected with the fixed scroll and receiving the orbiting scroll, the main frame receiving the rotary shaft therethrough, a delivery path defined at least one of the orbiting scroll or the main frame and configured to allow the oil supplied from the rotary shaft to move therethrough, a fixed path that fluidly communicates with the delivery path and that is configured to convey the oil between the orbiting scroll and the fixed scroll; and a regulating portion disposed in at least one of the main frame or the fixed scroll and configured to control an opening of the delivery path or the fixed path, wherein the regulating portion includes a check valve disposed in the at least one of the main frame or the fixed scroll, the check valve configured to prevent backflow of the oil in the delivery path or the fixed path.

2. The compressor of claim 1, wherein the main frame or the fixed scroll further includes an arrangement groove disposed in the delivery path or the fixed path, and wherein the regulating portion includes (i) a shielding portion configured to reciprocate in the arrangement groove and block the delivery path or the fixed path and (ii) an elastic portion disposed in the arrangement groove and configured to bias the shielding portion toward the delivery path or the fixed path.

3. The compressor of claim 2, wherein the arrangement groove includes (i) a moving path in which the shielding portion reciprocates, and (ii) an accommodating path extended from the moving path and receiving the elastic portion.

4. The compressor of claim 2, wherein the regulating portion is configured to open or close the fixed path.

5. The compressor of claim 1, wherein the regulating portion is configured to selectively block the opening of the delivery path or the fixed path.

6. The compressor of claim 1, further comprising a case, wherein the driving unit is included in the case.

7. The compressor of claim 6, wherein the case has a discharge outlet for discharging the refrigerant and an oil storage space for receiving the oil.

8. The compressor of claim 1, A compressor comprising:

a driving unit;

a rotary shaft rotatable by the driving unit and configured to supply oil; and a compression unit coupled to the rotary shaft and configured to compress a refrigerant, the compression unit configured to be lubricated by the oil supplied by the rotary shaft, wherein the compression unit includes:

an orbiting scroll rotatably engaged with the rotary shaft and configured to orbit as the rotary shaft is rotated, a fixed scroll engaged with the orbiting scroll and configured to compress and discharge the refrigerant in cooperation with the orbiting scroll, a main frame connected with the fixed scroll and receiving the orbiting scroll, the main frame receiving the rotary shaft therethrough, a delivery path defined at at least one of the orbiting scroll or the main frame and configured to allow the oil supplied from the rotary shaft to move therethrough, a fixed path that fluidly communicates with the delivery path and that is configured to convey the oil between the orbiting scroll and the fixed scroll; and a regulating portion disposed in at least one of the main frame or the fixed scroll and configured to control an opening of the delivery path or the fixed path, wherein the compressor further comprises a valve disposed in the main frame or the fixed scroll and configured to control opening of the delivery path or the fixed path.

9. A compressor comprising:

a driving unit;

a rotary shaft rotatable by the driving unit and configured to supply oil; and a compression unit coupled to the rotary shaft and configured to compress a refrigerant, the compression unit configured to be lubricated by the oil supplied by the rotary shaft, wherein the compression unit includes:

an orbiting scroll rotatably engaged with the rotary shaft and configured to orbit as the rotary shaft is rotated, a fixed scroll engaged with the orbiting scroll and configured to compress and discharge the refrigerant in cooperation with the orbiting scroll, a main frame connected with the fixed scroll and receiving the orbiting scroll, the main frame receiving the rotary shaft therethrough, a delivery path defined at at least one of the orbiting scroll or the main frame and configured to allow the oil supplied from the rotary shaft to move therethrough, a fixed path that fluidly communicates with the delivery path and that is configured to convey the oil between the orbiting scroll and the fixed scroll; and a regulating portion disposed in at least one of the main frame or the fixed scroll and configured to control an opening of the delivery path or the fixed path, wherein the main frame or the fixed scroll further includes an arrangement groove disposed in the delivery path or the fixed path, wherein the regulating portion includes (i) a shielding portion configured to reciprocate in the arrangement groove and block the delivery path or the fixed path and (ii) an elastic portion disposed in the arrangement groove and configured to bias the shielding portion toward the delivery path or the fixed path, and wherein the regulating portion further includes an arrangement module inserted into the arrangement groove, wherein the shielding portion and the elastic portion are disposed in the arrangement module.

10. The compressor of claim 9, wherein the arrangement module includes (i) a moving path that fluidly communicates with the delivery path or the fixed path and that is configured to allow the shielding portion to reciprocate therein, and (ii) an accommodating path extended from the moving path and receiving the elastic portion.

11. The compressor of claim 10, wherein the accommodating path has a diameter smaller than a diameter of the moving path.

12. The compressor of claim 10, wherein the arrangement module further includes:

an inlet hole located at one end of the moving path and configured to receive the oil from the delivery path or the fixed path, and a guide hole located at an outer circumferential surface of the moving path or an outer circumferential surface of the accommodating path and configured to discharge the oil to the delivery path or the fixed path.

13. The compressor of claim 9, wherein the regulating portion further includes a sealing portion configured to seal the arrangement groove to fix the arrangement module.

14. The compressor of claim 9, wherein the arrangement module includes:

an inlet hole that fluidly communicates with the delivery path or the fixed path and that is configured to supply the oil into the delivery path or the fixed path, and a guide hole configured to discharge the supplied oil to the delivery path or the fixed path, wherein the shielding portion is configured to block the inlet hole.

15. The compressor of claim 14, wherein the shielding portion includes:

a main head configured to block the inlet hole, and a shielding pin extended from the main head, wherein the elastic portion includes a spring configured to receive the shielding pin and bias the main head.

16. The compressor of claim 15, wherein the regulating portion further includes:

a sealing portion engaged with the arrangement groove and configured to fix the arrangement module, and a grasp portion extended from the sealing portion or the arrangement module and configured to receive the shielding pin and permit the shielding pin to reciprocate, the grasp portion configured to mount the spring.

17. The compressor of claim 16, wherein the grasp portion is extended from the sealing portion to the inlet hole, and wherein the arrangement module further includes an insertion hole configured to receive the grasp portion, the insertion hole fluidly communicating with the inlet hole.

18. The compressor of claim 16, wherein the shielding pin has a length longer than a length of the main head disposed at a free end of the grasp portion.

19. The compressor of claim 15, wherein the shielding portion further includes a step difference head extended from the main head and having a diameter smaller than a diameter of the main head, the shielding portion configured to be inserted into the inlet hole.

* * * * *